US012624867B2

(12) United States Patent
Dupuy

(10) Patent No.: US 12,624,867 B2
(45) Date of Patent: May 12, 2026

(54) PORTABLE HEATER AND COOLER

(71) Applicant: Alexandre Dupuy, San Diego, CA (US)

(72) Inventor: Alexandre Dupuy, San Diego, CA (US)

(73) Assignee: Alexandre Dupuy, San Diego, CA (US)

( * ) Notice: Subject to any disclaimer, the term of this patent is extended or adjusted under 35 U.S.C. 154(b) by 246 days.

(21) Appl. No.: 18/456,495

(22) Filed: Aug. 27, 2023

(65) Prior Publication Data

US 2024/0068713 A1 Feb. 29, 2024

Related U.S. Application Data

(60) Provisional application No. 63/401,637, filed on Aug. 27, 2022.

(51) Int. Cl.
*F25B 21/04* (2006.01)
*F25B 27/00* (2006.01)

(52) U.S. Cl.
CPC ..... *F25B 21/04* (2013.01); *F25B 27/002* (2013.01)

(58) Field of Classification Search
CPC ..... F25B 21/02; F25B 21/04; F25B 27/00; F25B 27/002; F25D 31/005
See application file for complete search history.

(56) References Cited

U.S. PATENT DOCUMENTS 4,823,554 A * 4/1989 Trachtenberg ..... F25D 15/00 62/3.61
5,483,799 A * 1/1996 Dalto ..... F25B 21/04 62/3.6
6,598,403 B1 * 7/2003 Ghoshal ..... H10N 10/17 62/3.2
6,658,857 B1 * 12/2003 George ..... F25D 23/066 165/122
8,061,149 B1 * 11/2011 Gowans ..... A61J 1/165 62/3.62
10,299,525 B1 * 5/2019 Buckman ..... A42B 1/008
10,674,570 B2 * 6/2020 Libman ..... H05B 6/688
10,687,391 B2 * 6/2020 Cochran ..... H05B 3/0057
10,989,466 B2 * 4/2021 Alexander ..... A61J 1/16
11,026,299 B2 * 6/2021 Laghi ..... H05B 6/105
11,395,556 B2 * 7/2022 Spotorno ..... A47J 27/09
11,472,624 B2 * 10/2022 Alexander ..... F25B 21/02
11,639,816 B2 * 5/2023 Cauchy ..... H10N 10/17 62/3.7
11,821,660 B2 * 11/2023 Zimmer ..... F25D 11/003
2002/0005216 A1 * 1/2002 Oravetz ..... H10N 10/80 136/203
2002/0184906 A1 * 12/2002 Faries, Jr. ..... A61J 1/165 62/229

(Continued)

*Primary Examiner* — Filip Zec

(57) ABSTRACT

Disclosed is a portable heating/cooling device comprising one or more heating elements for transferring heat to an object, one or more cooling elements for cooling an object; wherein said heating or cooling elements are adapted for selectively providing either heating or cooling based on temperature maintenance requirements, an integrated control unit for regulating the temperature, one or more temperature sensors that provide real-time feedback to the control unit, and a power source for supplying energy to the heating/cooling elements.

18 Claims, 14 Drawing Sheets

(56) References Cited

U.S. PATENT DOCUMENTS

| | | | | |
|---|---|---|---|---|
| 2008/0047948 | A1* | 2/2008 | Rosenbloom | A47J 36/26 219/386 |
| 2017/0259956 | A1* | 9/2017 | Hori | F25B 21/04 |
| 2020/0189826 | A1* | 6/2020 | Alexander | A47J 36/2483 |
| 2021/0341184 | A1* | 11/2021 | Ilercil | F25B 21/02 |

* cited by examiner

PORTABLE HEATER AND COOLER

CROSS REFERENCE

This US Non-Provisional patent application claims the benefit of the U.S. Provisional Patent Application No. 63/401,637, filed on Aug. 27, 2022.

BACKGROUND

In today's fast-paced world, people frequently find themselves on the move, whether it's for work, leisure, or adventure. During these mobile journeys, access to conventional 110V/220V food warmers becomes problematic, limiting the ability to enjoy hot, freshly cooked meals. Traditional food warmers are designed for use in stationary settings with ready access to electrical outlets, making them unsuitable for scenarios such as camping, road trips, and other mobile activities.

For instance, consider the situation of a family embarking on a camping trip in a remote wilderness area. After a long day of hiking, they desire a warm and hearty meal to refuel. However, there's no 110V/220V electrical hookup available in the midst of nature. Similarly, individuals setting out on a road trip may encounter situations where a 110V outlet is inaccessible, such as during rest stops or at scenic viewpoints.

The need for a portable food warming solution tailored to mobile environments is evident. Such a device would allow individuals to enjoy hot meals on the go, whether they are deep in the wilderness, at a roadside picnic, or on a cross-country road trip.

This application relates to portable cordless battery power heating and cooling applications, based on conduction, convection, RF heating and Thermoelectric (Pelletier effect) to heat up or cool.

The challenge of maintaining the desired temperature for items, such as food, while on the move has long been a vexing one. Traditional thermos containers often fall short in retaining heat for extended periods, leaving individuals in need of a reliable solution. Similarly, isotherm bags employed by food companies struggle to preserve the warmth of freshly prepared meals during transit from the kitchen to the customers. The primary differentiator among various portable containers designed to preserve food at either hot or cold temperatures has predominantly centered around their emphasis on robust sealing lids and the integration of high-density foam insulation.

One crucial concern arises when the internal temperature of food enters the range of 40° F. to 140° F., as this provides a fertile breeding ground for bacteria, thereby significantly increasing the risk of foodborne illnesses. To ensure the safety of cooked food, it is imperative to uphold an internal temperature of at least 140° F. (60° C.) for an adequate duration.

While a variety of coolers of diverse sizes and shapes are available, their effectiveness in maintaining temperatures above 80° F. for more than four hours remains a challenge. This limitation hampers the ability to keep both food and beverages at the desired warmth during extended journeys or outdoor activities.

The solution presented here is a device that harmoniously integrates state-of-the-art of insulation, sealing, and cutting-edge heating/cooling elements to maintain your food at a desired temperature for extended periods. Portable, user-friendly, and engineered for those whose busy lives demand a reliable means to savor warm meals while on the move.

At its core, this food warmer/cooler can, in some configurations, be designed with a vacuum insulation layer, intended to function as a thermal barrier, effectively minimizing the transfer of thermal energy between different areas.

What sets this innovation apart is its intelligent heating system, that resides inside the container. In the settings applying heat, these heating elements come alive with precision with a temperature sensor that communicates with a control unit controlling the different heating elements, only when the food's temperature descends to a predefined threshold, the heating elements will turn on this mechanism enable to preserve the battery life. This meticulous vigilance guarantees that the meal remains warm but also certifiably safe for consumption.

When set to the cooling mode, the cold elements are activated, specifically, the thermoelectric components maintain a cold temperature within, or in alternative configurations, they can effectively chill items such as food or liquids.

Designed with the practical needs of busy individuals in mind, this versatile warmer/cooler is engineered to maintain the desired temperature of various consumables, including food, drinks, and liquids, without the need for prolonged electrical connection. It can effectively preserve the consumables for many hours, making it the ideal companion for those who desire hot meals on the go. Whether you're a dynamic food delivery driver, an adventurous outdoor enthusiast, or simply someone who insists on savoring warm, flavorful meals during your on-the-go escapades, this device has you covered. Furthermore, it can also function as a cooking tool by adjusting the temperature to a higher setting.

DETAILED DESCRIPTION

The present application discloses techniques, apparatus, and systems for creating heat or cooling objects. The techniques use conduction, convection, RF heating, or the Peltier effect. Conduction is the transfer of heat through direct contact. Convection is the transfer of heat through the movement of fluids. RF heating is the transfer of heat through electromagnetic waves. The Peltier effect is the creation of a temperature difference across a junction of two different materials when an electric current is passed through it.

The present techniques, apparatus, and systems can be used in a variety of portable applications, such as to maintain objects at a specific temperature, elevate the temperature of objects, or cool objects. For example, these techniques can be used to keep food warm, heat beverages, or cool electronic devices.

Figure 1:
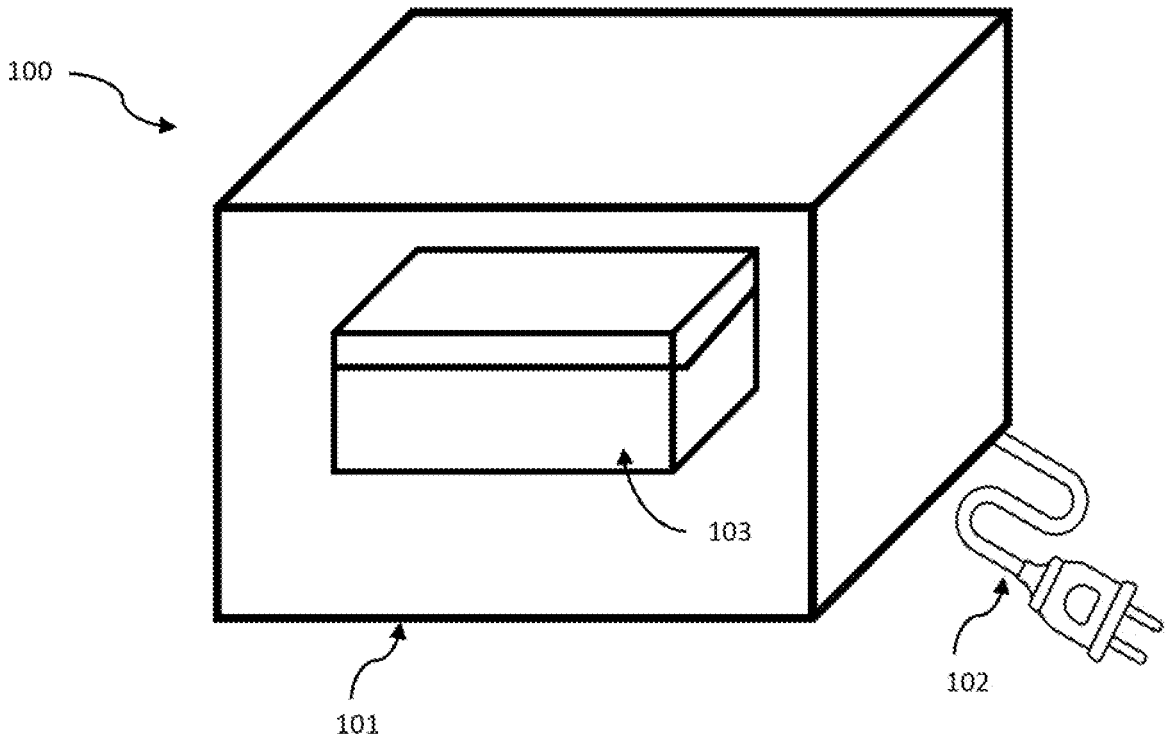
FIG. 1 illustrates a conventional plugged-in warmer into 110V/220V.

FIG. 1 illustrates a conventional food warmer 100 that can be found on any online shopping website. These food warmers typically use large resistors that are power-hungry and require a 110V or 220V power outlet 102, depending on the country. There are now some versions that can be plugged into the 12V power outlet of a car or truck. However, the temperature inside the food warmer drops quickly as soon as the device is disconnected from the power source. An isotherm bag 101, for example, can be used to hold a box 103 that contains the food warmer. Other solutions include a hot plate inside an insulating bag, such as the Hotlogic®.

However, there are cases where there is no access to a 12V, 110V, or 220V power outlet. For example, children going to school may want to have a warm lunch, but they may not be allowed to use a power outlet in the classroom.

Figure 2:
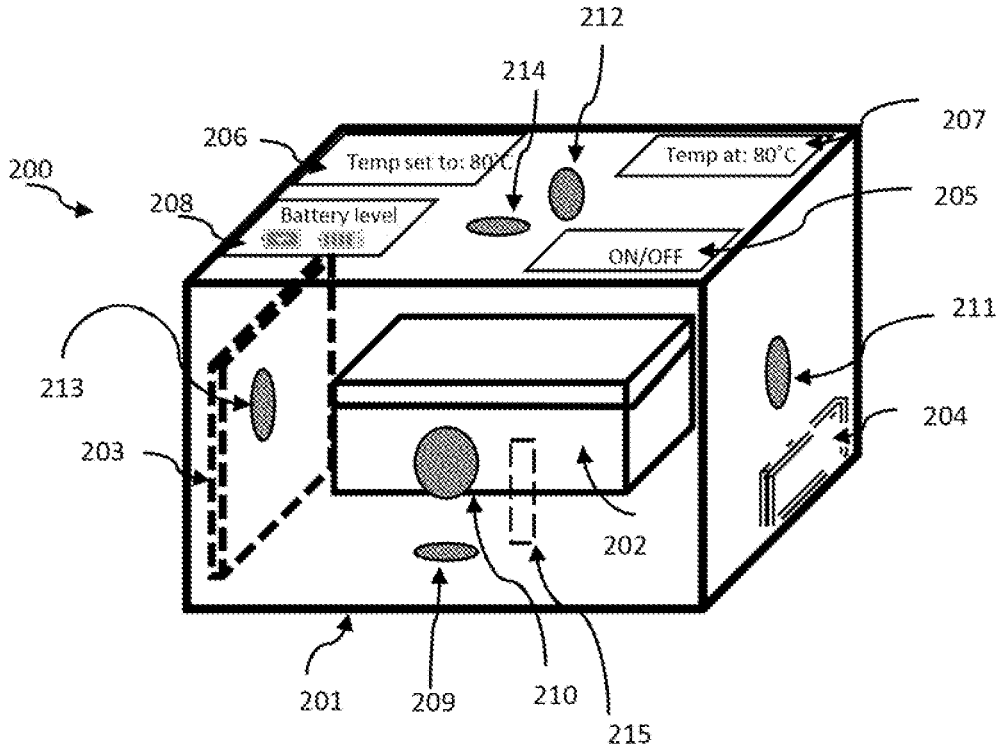
FIG. 2 depicts a portable cordless battery-powered heating and cooling device with automatic temperature regulation to maintain the desired temperature setting.

FIG. 2 illustrates a more practical solution (200) by being cordless and self-powered solution. The conventional power cord is supplanted by a battery (203) seamlessly integrated into the container (201). However, this battery can be easily removed to be charged or replaced. The container's walls are designed to incorporate vacuum insulation, air insulation, foam insulation, or any combination thereof. In addition, heating elements are positioned on all sides of the container (201).

To ensure an even temperature distribution, heating or cooling elements are placed on different walls of the box. In this example, only one heating or cooling element is placed on each of the walls (210, 211, 212, 213) of the container (201), as well as the top (209) and bottom (214). The elements can be heating or cooling, depending on the application.

Operational control is conveniently at the user's fingertips with a user-friendly interface. A prominent on/off button (205) empowers users to activate or deactivate the heating elements that are located inside 202. The container (201) also features a temperature adjustment control (206) and a digital temperature display (207) to keep users informed about the temperature being measured.

A vital component of this container is the battery level indicator (208), which signals a full charge or indicates when it's time to recharge the battery, ensuring uninterrupted functionality.

The heart and brain of this container reside in the integrated digital temperature control and voltage control module (204). This module serves as a precision temperature regulator, maintaining the temperature within a user-defined range. By default, the temperature delta is set at 5° C. To achieve this, a small sensor is strategically positioned inside the container, capable of utilizing various sensor types such as RTD (Resistance Temperature Detectors), thermocouples, or thermistors, depending on the specific application and provide feedback to the control unit (204). RTDs offer superior accuracy, albeit at a higher cost, while thermocouples and thermistors, though less precise, are more cost-effective.

The temperature control module (204) exercises its authority by modulating the power supply to electrical devices based on temperature data obtained from a high-precision Negative Temperature Coefficient (NTC) temperature sensor. This type of sensor, known as an NTC thermistor, exhibits a negative temperature coefficient, meaning its resistance diminishes as temperature rises. This dynamic module (204) expertly manages battery power, toggling it on or off as dictated by the temperature sensor's feedback. Although only one sensor is depicted, it is conceivable to incorporate a sensor (215) on each heating/cooling element. This configuration enables the temperature control module (204) to make independent decisions regarding heating or cooling for each element, ensuring precise maintenance of the desired temperature. In some configuration the module (204) may also incorporate a radio module, enabling communication via various standards such as Bluetooth, Wi-Fi, or LTE. The element (202) represents the item, substance, or any consumable, including food or liquids, that necessitates temperature maintenance. The shape in FIG. 2 is not limited to a rectangle; it can be any shape. The following illustration provides a more detailed description of this container.

Figure 3:
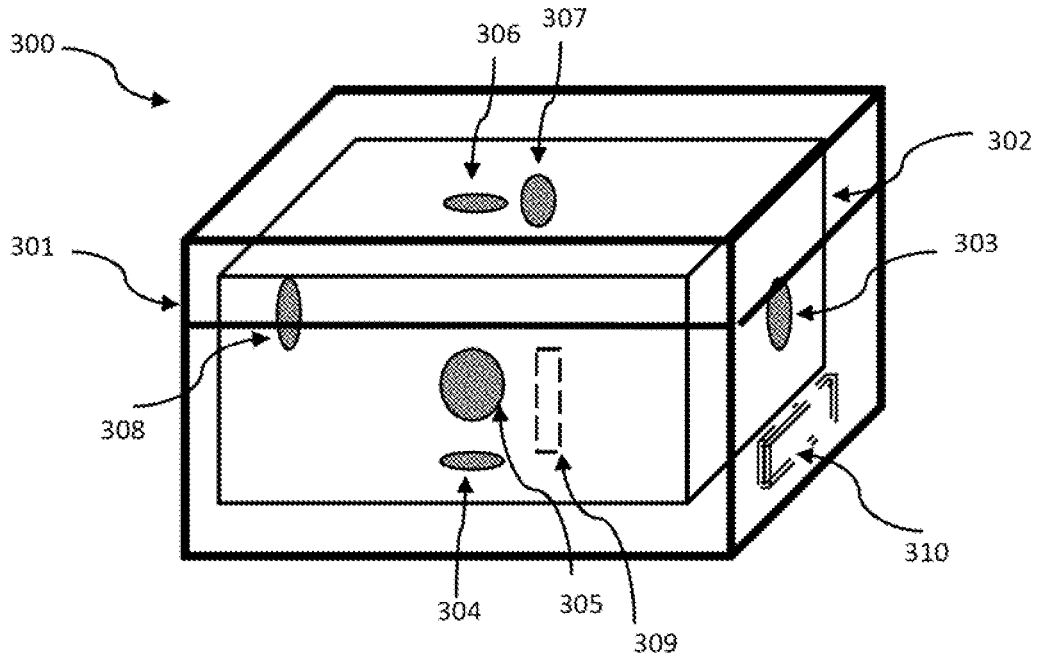
FIG. 3 illustrates a potential placement for the heating/cooling elements along with a temperature sensor providing feedback to the integrated temperature control unit.

FIG. 3 illustrates a container (300) for consumables such as food, liquids, or any substance that requires temperature maintenance. To ensure an even temperature distribution, heating or cooling elements are placed on different walls of the box. In this example, one heating or cooling element is placed on each of the walls (303, 305, 307, 308) of the box, as well as the top (306) and bottom (304). The elements can be heating or cooling, depending on the application. A temperature sensor (309) connected to the integrated temperature control unit (310) allows for efficient control of the heating or cooling elements. While only one sensor is shown, it is possible to have a sensor (309) on each element so that the temperature control module can make decisions about whether to heat or cool each element individually to maintain the desired temperature.

Different techniques that can be used for the heating elements are described below.

Ohmic or electric resistant heating is less efficient but easy to implement, requiring direct electrode contact with the medium. The heat generated within the product is a result of resistance losses.

Induction heating produces heat through the Joule effect in a conductor by inducing eddy currents, similar to how a transformer operates when a current in the secondary winding is induced by a current in the primary winding.

RF heating and RF capacitive heating, offers several advantages over conventional heating methods. RF heating provides more uniform and rapid heating compared to traditional methods, which rely on conduction and convection for heat transfer, often requiring extended periods. To achieve RF heating, one or multiple amplifiers can be utilized. Efficient power amplifiers like class E, class-F, or inverse class-F amplifiers can be employed, operating close to P1 dB. This efficiency extends the battery life. These RF amplifiers are energized by RF sources, such as oscillators (VCOs, crystals, TCXOs, etc.). The RF energy is then radiated into the object to generate heat.

The device features a physical On/Off button and LEDs indicating the battery or batteries' charge level. Additionally, it displays the desired temperature setpoint using a three-digit LED readout, adjustable through plus and minus buttons. Another three-digit LED display shows the actual temperature of the object being heated.

Thermoelectric energy conversion utilizes the Peltier heat generated when an electric current is passed through a thermoelectric material to provide a temperature gradient with heat being absorbed on the cold side, transferred through (or pumped by) the thermoelectric materials and rejected at the sink, thus providing a refrigeration capability. The advantages of thermoelectric solid state energy conversion are compactness, quietness (no moving parts), and localized heating or cooling.

Figure 4:
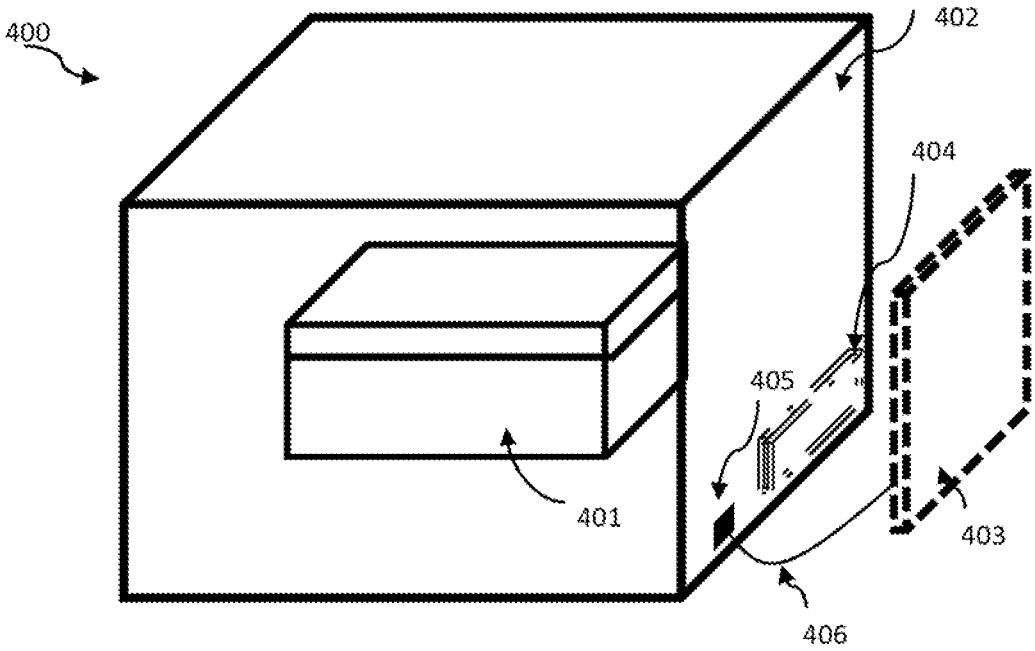
FIG. 4 illustrates a configuration example in which the batteries are positioned outside the enclosure housing the heating/cooling elements, connected via a cable.

FIG. 4 shows a different configuration (400) in which the battery (or batteries) (403) is located outside the container (402) and is connected to the container through a cable (406) and a port (405). The battery then powers the heating/cooling elements (401) inside the container, which are described in reference to FIG. 3.

Figure 5:
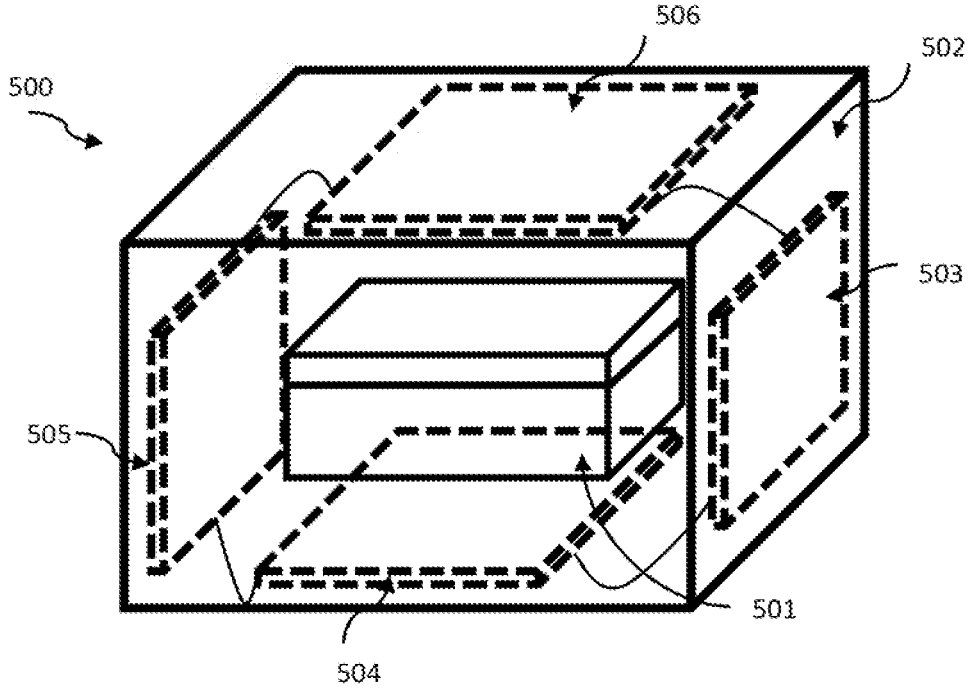
FIG. 5 illustrates an example of a portable cordless battery power heating/cooling with different battery configurations.

FIG. 5 depicts a configuration featuring multiple batteries (503, 504, 505, 506) housed within container (502), serving as the power source for the heating/cooling elements located in (501). This solution is designed for prolonged usage, ideal for scenarios like long-distance flights, boat trips, extended hiking excursions, or extended car journeys. The battery or batteries can be easily slid in and out for convenient charging or replacement.

Figure 6:
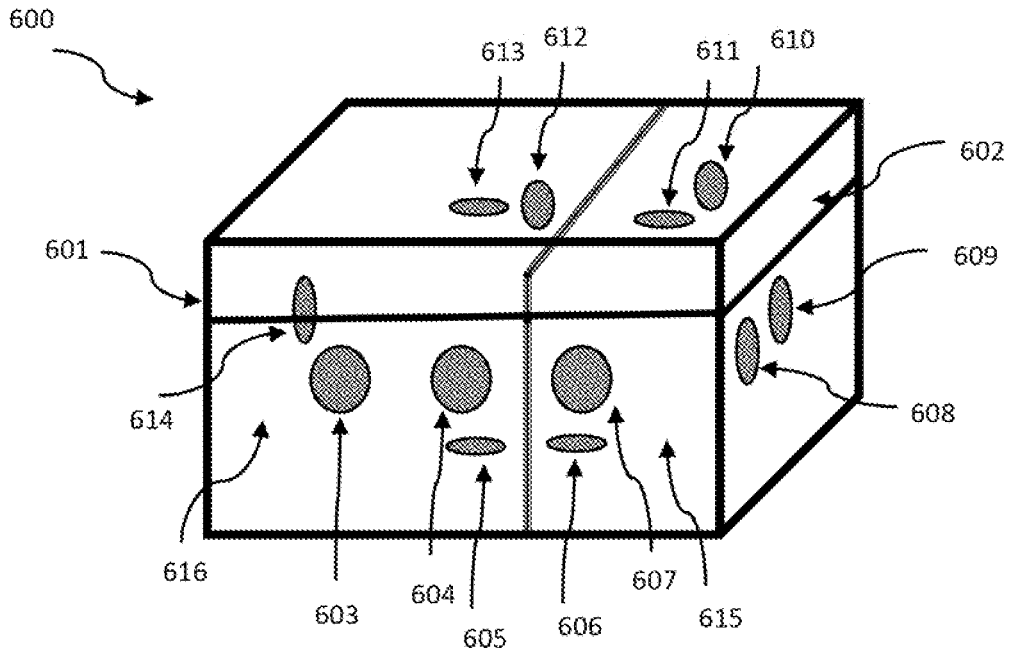
FIG. 6 illustrates a potential arrangement for the heating/cooling elements, with multiple elements per face of the box to be heated or cooled.

FIG. 6 illustrates a versatile configuration featuring multiple heating elements (606, 611, 610, 611, 608, 609) and multiple cooling elements (603, 604, 605, 612, 613, 614) integrated into a single container (604). This design allows for adaptable usage, making it possible to employ the same container on different days—for instance, using it entirely for heating one day and exclusively for cooling the next.

Alternatively, the container (602) can be partitioned into distinct compartments, enabling one compartment to provide heating (615) while the other offers cooling (616). This versatility makes it an ideal choice for students heading to school, who may desire a warm lunch and a chilled dessert, or for individuals shopping at a distance from their homes, ensuring their items remain at the desired temperature.

Figure 7:
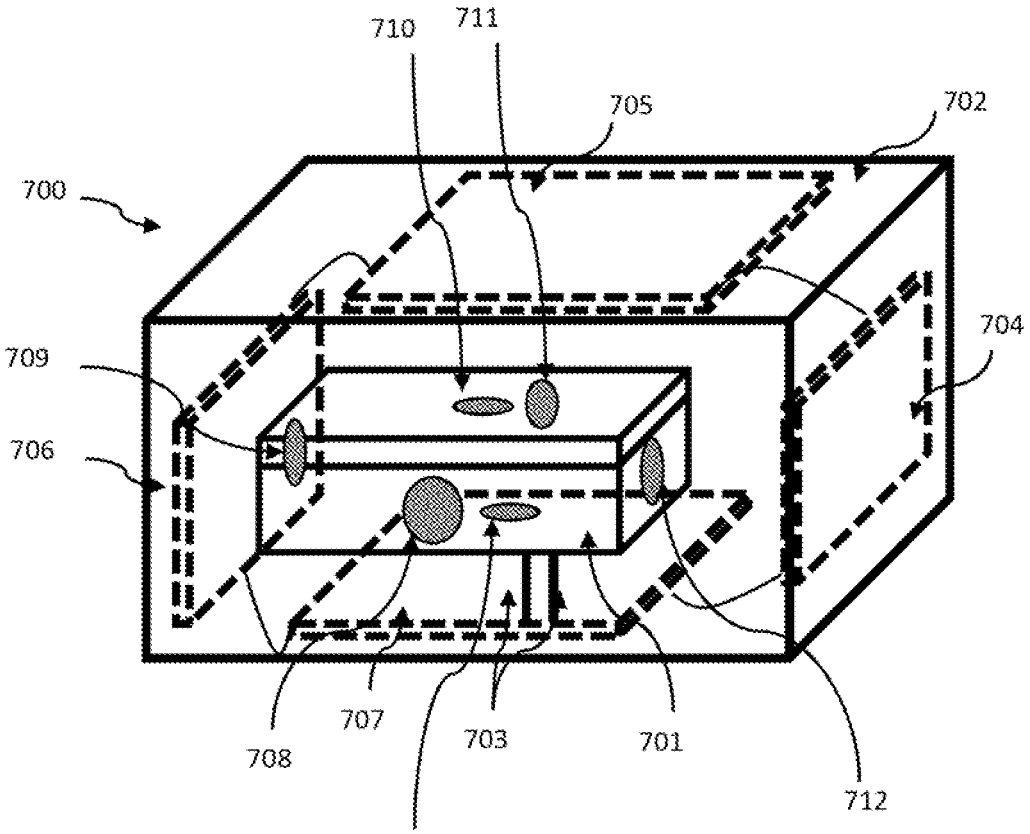
FIG. 7 illustrates an example of a connection between the container and the batteries.

In FIG. 7 presents an alternative configuration where the heating/cooling elements (708, 709, 710, 711, 712, 713) are located within a separate container (701). This container could, for instance, take the form of a lunch box placed inside an insulated bag. The connection (703) between the two containers, namely container (701) and container (702), facilitates the transfer of voltage from the batteries (704, 705, 706, 707) to power the internal heating or cooling elements within container (701). This interconnection, labeled as (703), can be established through various methods: conventional wired connections are one option, or it can involve two pins making contact when the two containers are securely attached to prevent accidental disconnection. Moreover, in select cases, this connection can be achieved wirelessly, leveraging advanced wireless power transfer technology.

Figure 8:
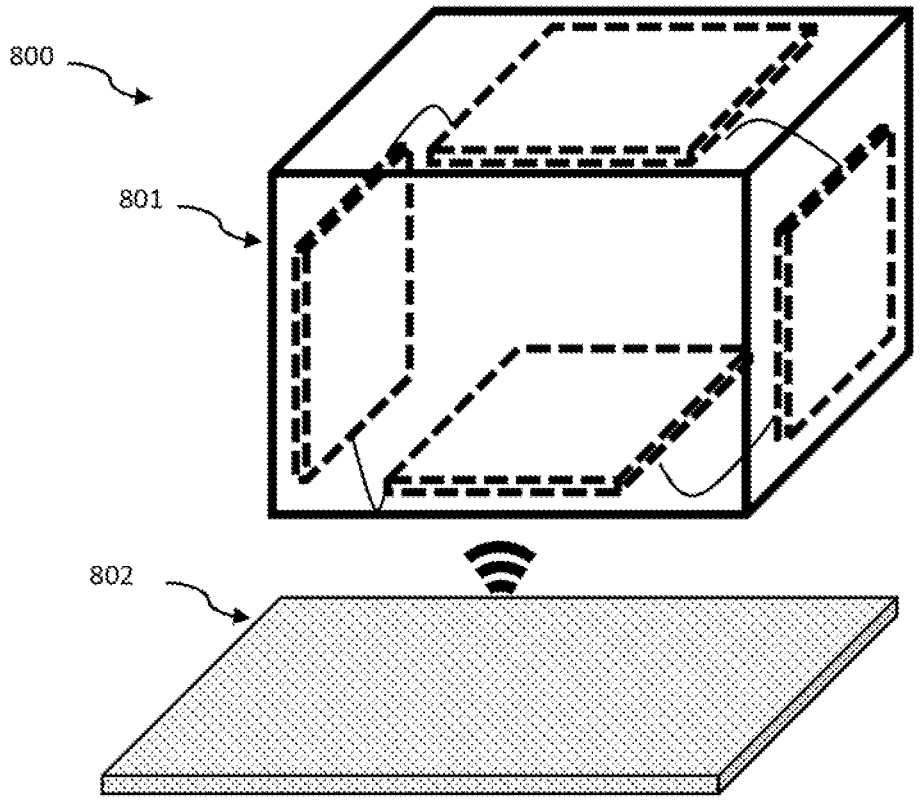
FIG. 8 illustrates an example of a wireless charging of the battery/batteries.

FIG. 8 illustrates an alternative configuration (800) in which the batteries are charged wirelessly. Depending on the size of the container (801), the charging pad (802) can be conveniently placed on a kitchen counter. For instance, when a student returns from school, they can place their container on the pad at night for wireless battery charging. Alternatively, in the case of a shopping bag or larger container, the charging pad can be positioned on the floor, in a garage, or within a closet for effortless recharging.

Figure 9A:
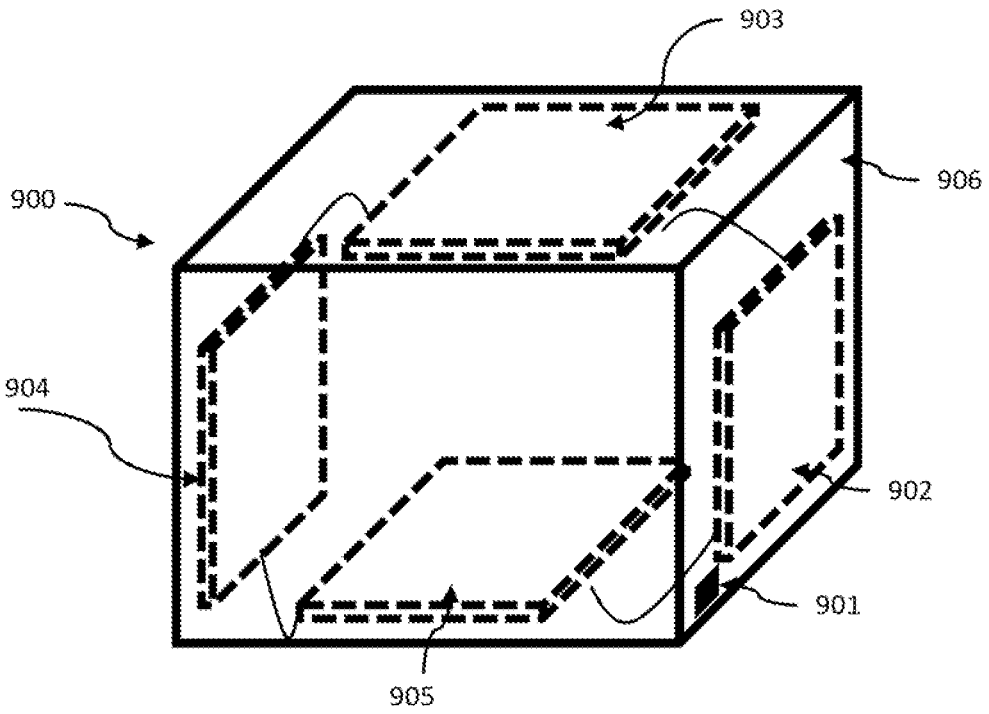
FIG. 9*a* illustrates an example to have a wired connection for charging the battery/batteries.

FIG. 9*a* illustrates an alternative method for charging the batteries (902, 903, 904, 905) within a container 906 through a dedicated port (901). This approach closely resembles the common process of charging a cell phone, featuring a port that connects to a cable, which can be plugged into a standard wall outlet for recharging.

Figure 9B:
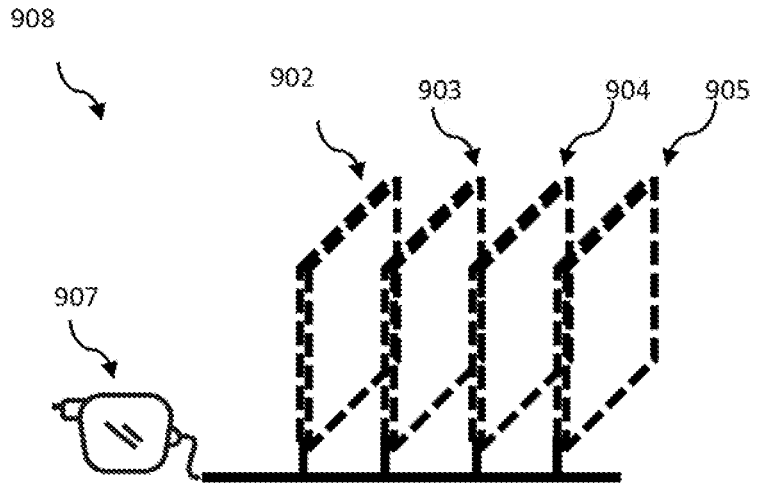
FIG. 9*b* illustrates an example for charging the battery/batteries removed from the device.

FIG. 9*b* illustrates an alternative method (908) for charging the batteries (902, 903, 904, 905), specifically those that have been removed from the device. Subsequently, a transformer (907) is connected to a wall outlet to charge these batteries.

Figure 10:
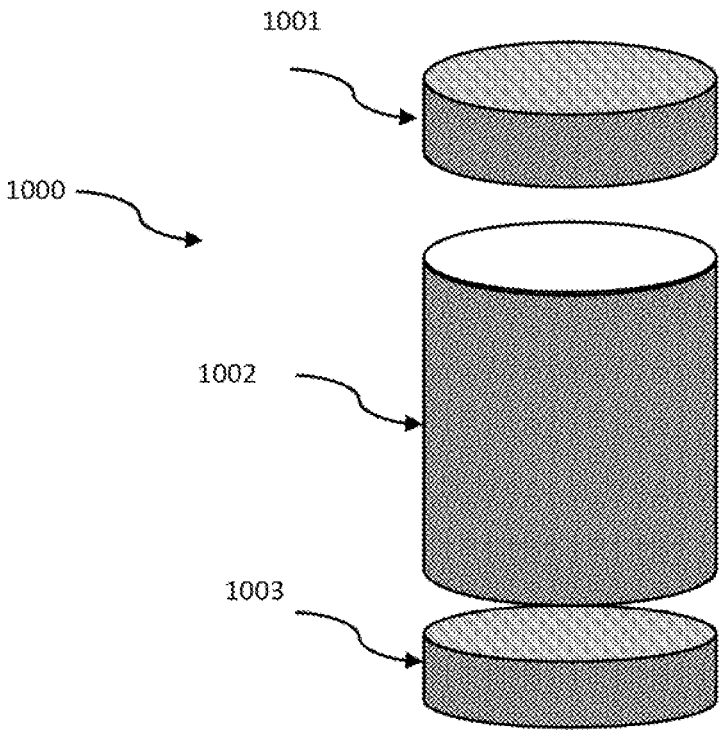
FIG. 10 illustrates an alternative configuration where the battery/batteries are housed within the lids of a container, allowing for convenient screwing and unscrewing.

FIG. 10 illustrates a configuration (1000) that offers a distinct approach to housing batteries within the container. In this design, batteries are placed within both the top cap (1001) and the bottom section (1003) of the container. What sets this apart is the user-friendly mechanism that enables the batteries to be effortlessly attached or detached from the primary container (1002) by a simple screwing and unscrewing action. This innovative configuration ensures that the batteries can be easily accessed and replaced as needed to be charged, adding a layer of convenience and versatility to the overall design. Whether for maintenance or customization, this approach simplifies the user's interaction with the container's power source, contributing to a seamless and efficient user experience. In this arrangement, the heating/cooling elements can be strategically positioned on the walls of (1002) as well as in the lids (1001) and (1003).

Figure 11A:
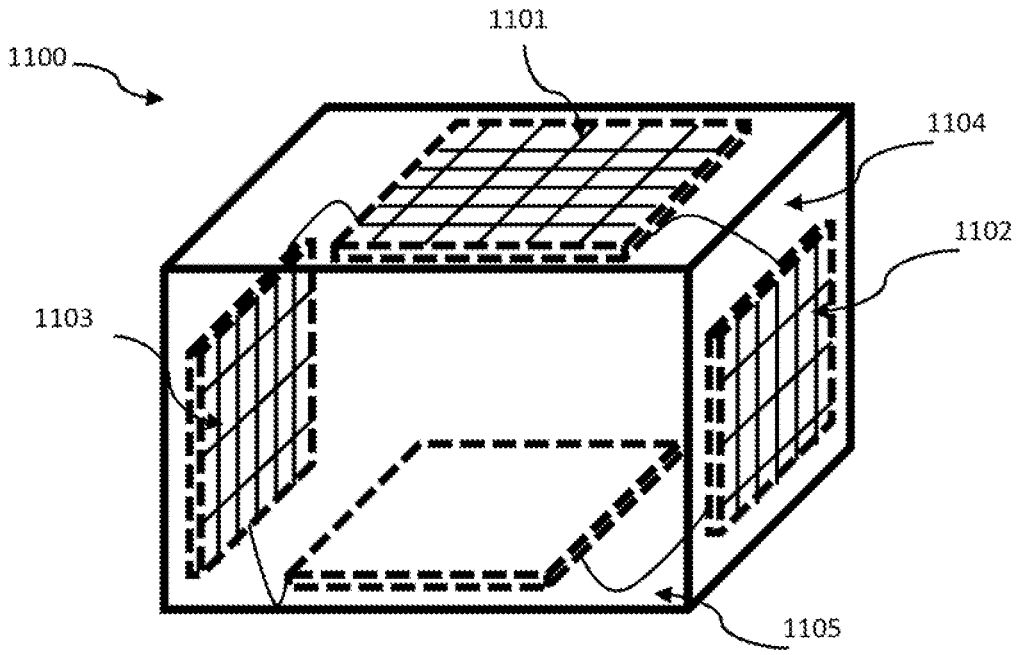
FIG. 11*a* illustrates an alternative configuration where the external container features solar panels on all sides, except for the side where the container rests.

FIG. 11*a* illustrates an alternative implementation featuring solar panels. In certain scenarios, the system's battery or batteries can be recharged through the integration of solar cells (1101, 1002, 1003). Depending on the configuration, the system (1100) can incorporate multiple solar cells. In the example depicted in FIG. 11, five solar cells are shown, with cells (1004) and (1005) omitted for clarity.

Figure 11B:
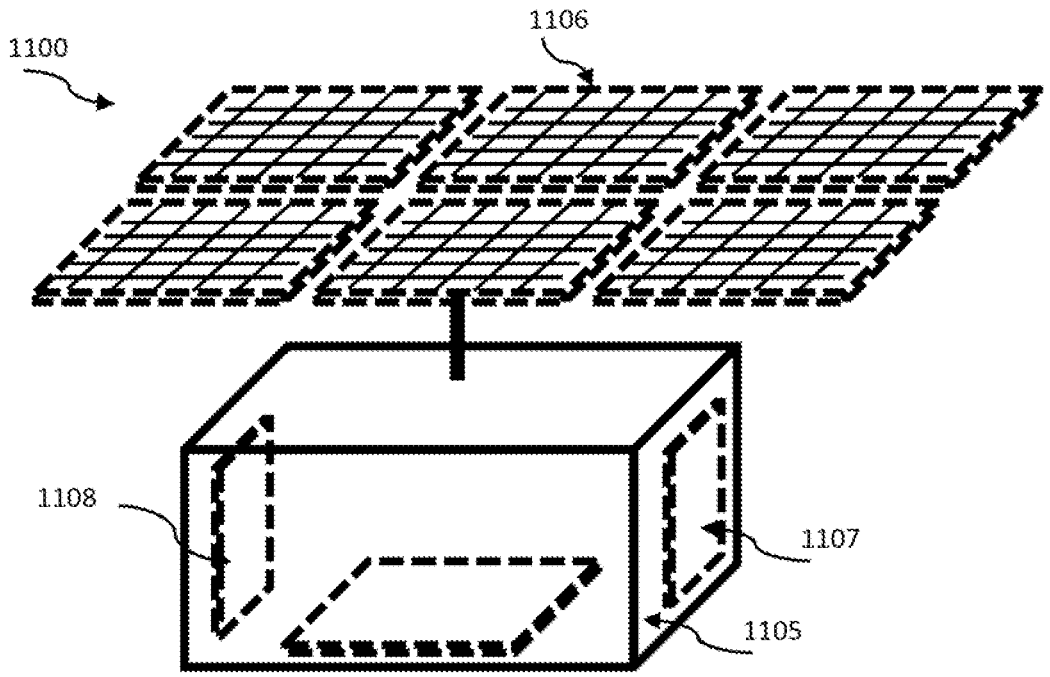
FIG. 11*b* an alternative configuration is depicted, showcasing external container attributes that incorporate foldable solar panels capable of expanding upon unfolding.

FIG. 11*b* illustrates an innovative configuration (1100) presenting a foldable solar panel system that offers expandability based on specific requirements while seamlessly connecting to the container (1105). This depiction (FIG. 11*b*) showcases six solar panels (1106), although the actual quantity of solar panels employed can be tailored to suit the application at hand. Within this setup, the solar panels are designed to conveniently fold during transportation, efficiently unfurling to harness sunlight for recharging the onboard batteries.

These configurations prove to be practical, especially when on the move or in scenarios where access to traditional power sources may be limited or not possible. The incorporation of solar cells into the device's design not only underscores its environmental friendliness but also enhances its portability and self-sufficiency. Whether for outdoor adventures, remote expeditions, or eco-conscious everyday use, this solar-powered feature adds a dimension of adaptability and sustainability to the device's functionality.

Figure 12:
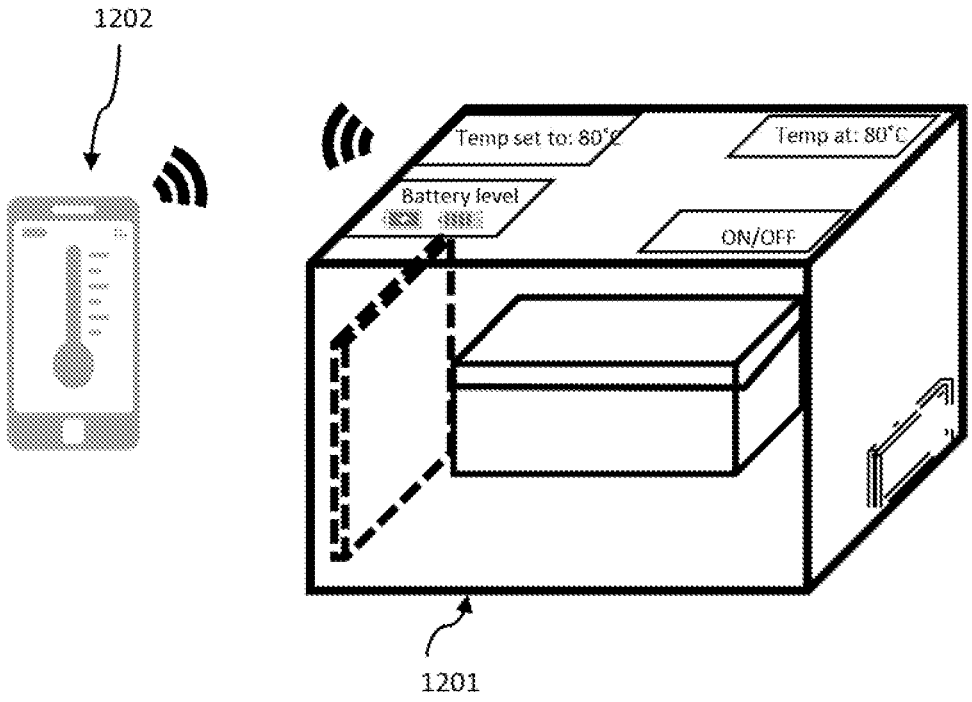
FIG. 12 illustrates a method for controlling, receiving updates, and receiving alerts regarding temperature and battery status.

In FIG. 12, the container (1201), which was previously detailed in FIG. 2, is accompanied by a smartphone running a dedicated app (1202). This configuration enables precise temperature control by establishing connections via Bluetooth, Wi-Fi, or LTE to a variety of devices, including computers, smartphones, smartwatches, or tablets. The accompanying application on these devices empowers users to both set and closely monitor the desired temperature of the contained object, whether it's solid, liquid, or gas. Practical applications for this technology extend to heating or cooling various items, such as consumables like food and beverages, or any substance that needs to be maintained at a precise temperature.

For food and beverage applications, the app includes an embedded database containing various temperature settings for different food and beverages. When the app is used on a device with internet access, it can connect to artificial intelligence for access to an expanded and more comprehensive database. This technology holds significant potential for various medical applications, such as the safe transport of organs, blood, and other critical medical supplies.

Furthermore, the application is designed to vigilantly monitor the battery level, providing timely alerts for recharging or replacing the battery as necessary to ensure uninterrupted functionality.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A portable temperature-regulating container comprising:

a thermally insulated enclosure defining at least one internal compartment configured to receive and store one or more items;

at least one temperature-conditioning element comprising:

one or more heating elements and one or more active cooling elements comprising a thermoelectric module being thermally coupled to a heat sink; or a combination thereof;

wherein the at least one temperature-conditioning element is disposed on, within, or adjacent to a surface of the enclosure, and wherein each of the one or more heating elements and each of the one or more cooling elements is independently controllable;

at least one temperature sensor positioned to detect a temperature within the at least one internal compartment;

a control module operatively coupled to the at least one temperature sensor and to the at least one temperature-conditioning element, the control module being configured to selectively activate the at least one temperature-conditioning element based on temperature readings from the at least one temperature sensor; and a modular battery-system power source electrically coupled to the control module and to the at least one temperature-conditioning element.

2. The portable temperature-regulating container of claim 1, wherein the one or more heating elements comprise at least one of an ohmic and electric resistive heating element, and the combination thereof comprises at least one ohmic heating element and at least one electric resistive heating element.

3. The portable temperature-regulating container of claim 1, wherein the one or more heating elements comprise one or more radio-frequency (RF) power amplifiers operable in high-efficiency classes selected from Class E, Class F, or inverse Class F, the one or more RF power amplifiers being coupled to one or more non-magnetic antenna structures positioned to radiate electromagnetic energy into at least one internal compartment.

4. The portable temperature-regulating container of claim 1, wherein the control module is configured to maintain one or more temperature zones within the at least one internal compartment, the one or more temperature zones including at least one heated zone, at least one cooled zone, or both.

5. The portable temperature-regulating container of claim 1, wherein the modular battery-system power source comprises of one or more batteries.

6. The portable temperature-regulating container of claim 5, wherein the one or more batteries are rechargeable via a cable configured to be connected to a power outlet.

7. The portable temperature-regulating container of claim 5, wherein the one or more batteries are removable for charging.

8. The portable temperature-regulating container of claim 1, wherein the modular battery-system comprises charging circuitry configured to receive power from photovoltaic solar panels mounted on exterior surfaces of the enclosure, the solar panels being either permanently integrated with the enclosure or configured as foldable panels that deploy for charging and retract for storage.

9. The portable temperature-regulating container of claim 5, wherein the one or more batteries are rechargeable using a wireless charger.

10. The portable temperature-regulating container of claim 1, further comprising:

a wireless communication module configured to transmit real-time temperature data and battery status data to a remote computing device and to receive temperature control commands from the remote computing device; and a software application executable on the remote computing device, the software application being configured to display zone-specific temperature data, receive user-defined temperature setpoints, and transmit configuration updates to the control module.

11. A portable temperature-regulating container device comprising:

a thermally insulated enclosure defining at least one internal configured to receive and store one or more items;

one or more high-efficient radio frequency (RF) power amplifiers electrically coupled to one or more radiative antennas configured to radiate RF electromagnetic energy to heat an object primarily via dielectric losses in the object rather than via induction heating of conductive materials;

at least one temperature sensor positioned to detect a temperature within the at least one internal compartment;

a control module operatively coupled to the at least one temperature sensor and to the one or more RF power amplifiers, the control module configured to selectively modulate the radiated RF power based on temperature readings from the sensor to maintain the object within a desired temperature range;

and a modular battery-system power source electrically coupled to the one or more RF power amplifiers and to the control module.

12. The portable temperature-regulating container of claim 10, wherein the wireless communication module is configured to interface with a mobile computing device running an application to control:

temperature monitoring displays;

item-specific temperature databases;

timer functionality for temperature-sensitive items; and automated alert generation for temperature violation events.

13. A method for maintaining zone-specific temperatures in a multi-zone portable insulated container, the method comprising:

detecting zone-specific temperatures within the container using one or more temperature sensors;

comparing the detected temperatures with predetermined temperature setpoints for each of the respective zones;

independently activating one or more heating elements in the zones requiring warming and independently activating one or more cooling elements in the zones requiring cooling;

adjusting operation of the one or more heating elements, the one or more cooling elements, or a combination thereof in real-time based on feedback from the one or more temperature sensors; and wirelessly communicating temperature status data between the container and a remote computing device.

14. The portable temperature-regulating container of claim 1, wherein the container is configured for medical supply storage and includes a microcontroller programmed with temperature requirements for items selected from the group consisting of organs, blood products, or critical medical supplies.

15. The portable temperature-regulating container of claim 1, wherein the control module is configured to make real-time, zone-specific temperature adjustments based on feedback from the at least one temperature sensor disposed within the container.

16. The portable temperature-regulating container of claim 1, wherein the control module is configured to activate the at least one temperature-conditioning element only when the temperature within the at least one internal compartment falls below or exceeds a predefined threshold, thereby optimizing battery life associated with the modular battery-system power source.

17. The portable temperature-regulating container of claim 1, wherein the modular battery system power source comprises one or more rechargeable battery units disposed within one or more detachable components of the enclosure, the one or more detachable components comprising at least one of a removable lid, a removable base, or a removable side panel.

18. The portable temperature-regulating container of claim 1, further comprising a user interface including:

a digital display configured to show current temperature and desired temperature setpoints;

one or more status indicators for different stored items;

one or more battery level indicators; and one or more control buttons configured to select temperature presets for different item categories.

* * * * *